United States Patent [19]

Moore

[11] 3,932,973

[45] Jan. 20, 1976

[54] INSUBARS

[76] Inventor: Alvin Edward Moore, Manini Way, Bay St. Louis, Miss. 39520

[22] Filed: Nov. 18, 1974

[21] Appl. No.: 524,504

[52] U.S. Cl. ..... 52/216; 52/91; 52/259; 52/577; 52/639; 52/644; 52/722; 52/DIG. 9

[51] Int. Cl.[2] ..... E04C 1/06

[58] Field of Search ..... 52/91, 576, 577, 86, 381, 52/259, 639, 644, 216, 722, 90

[56] References Cited

UNITED STATES PATENTS

| | | | |
|---|---|---|---|
| 596,010 | 12/1897 | Bande | 52/241 X |
| 1,189,360 | 7/1916 | Guerini | 52/91 X |
| 1,382,095 | 6/1921 | Lambert | 52/DIG. 9 |
| 1,397,301 | 11/1921 | Solan et al. | 52/577 |
| 1,465,653 | 8/1923 | Olander | 52/DIG. 9 |
| 1,477,520 | 12/1923 | Pittman | 52/DIG. 9 |
| 3,328,932 | 7/1967 | Cheskin | 52/323 |
| 3,721,059 | 3/1973 | Reynolds | 52/DIG. 9 |
| 3,857,215 | 12/1974 | Moore | 52/577 |

FOREIGN PATENTS OR APPLICATIONS

| | | | |
|---|---|---|---|
| 1,105,738 | 7/1955 | France | 52/576 |
| 13,988 | 1903 | United Kingdom | 52/639 |

*Primary Examiner*—Alfred C. Perham
*Attorney, Agent, or Firm*—Alvin Edward Moore

[57] ABSTRACT

A construction member including a row of cans and a pair of channels of mesh or the like, housing and holding the cans together. Each of these channels includes an elongated middle piece of the mesh and an elongated lateral piece on each side of the middle piece, angularly and integrally joined to the middle piece. The pair of opposite lateral pieces on each side of the can row meet at middle portions of the cans, and one of this pair has elongated edge portions which overlap edge portions of the other lateral piece of the pair. Fastening means (screws or other rod-like elements and/or epoxy putty or the like) pass thru the lapped edge portions on each side of the can row, and when, as is preferable, screws are utilized these are screwed into material of at least the end cans of the can row, thus holding the mesh channels together and the cans within the channels. The cans preferably contain low-cost insulation. The bars comprising cans and channels may be assembled into a plural-sided construction member by interlocking adjacent ends of the channels by means of attachment flanges on end portions of the channels. These flanges may be integral with the material of the channels or may be separate and bonded to channels. FIGS. 10 to 15 illustrate the construction members as built into walls and a roof, the mesh being impregnated and coated with stucco. The invention also comprises an elongated, light-weight, straight or curved building bar of channels, cans, and concrete or synthetic plastic.

19 Claims, 15 Drawing Figures

INSUBARS

In some respects the present invention comprises an improvement of the invention of my copending Application Ser. No. 313,454, filed on Dec. 8, 1972 now U.S. Pat. No. 3,857,215.

Among other purposes, some objects of this present invention are to provide: (1) a light-weight, strong, insulated building bar, called an "Insubar," including cans, overlapping channels of mesh and can-and-mesh fastening means, capable of being fastened to other, similar bars in a wall, roof, floor, deck or the like and, while thus in place, stuccoed over to form a building surface or surfaces; (2) such a bar in which the mesh comprises an end-portion tab or flange for attachment of the bar to a door or window frame; (3) a bar as in (1) above in which the cans are sheathed in two channels of mesh having elongated, lapped edge portions that are fastened together and to portions of the cans by tapping screws or other fastening means; (4) a building structure comprising bars specified in (3) above, fastened together by can-row-end flanges, and stucco over the mesh; (5) a construction bar which comprises bar-surfacing concrete, stuccoed mortar or organic plastic.

Other objects and the specific structure of the invention will become apparent from the following specification and the accompanying drawings. In these drawings FIG. 1 is a plan view, partly broken away, of a row of parallel-axes cans, held in position within channeled mesh, at least one channel of the mesh having an end tab or fastening flange at each end of the channel;

Figures 1, 2, 3, 4, 5, 6, 7, 8, 9, 10, 11, 12, 13, 14, 15:
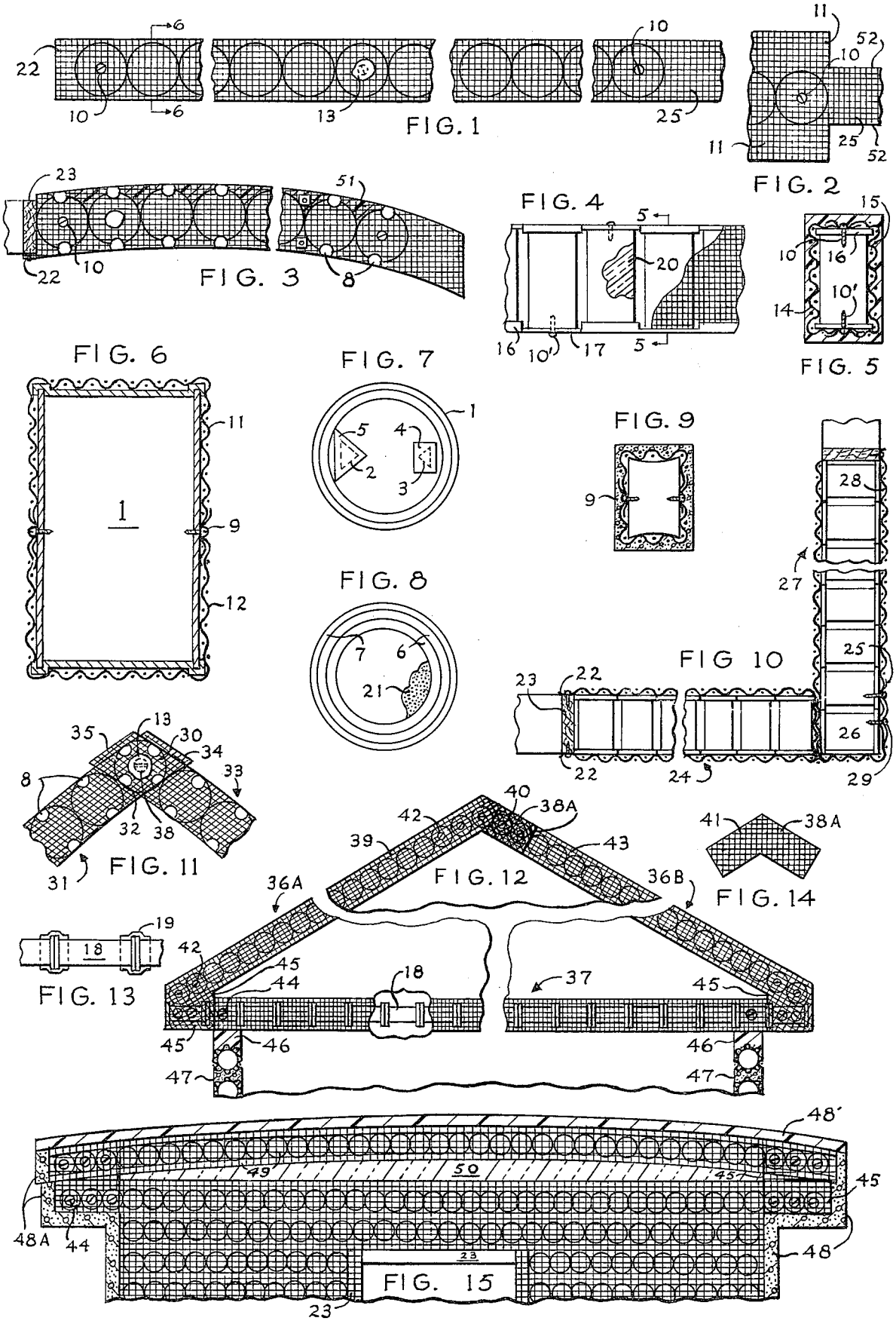
FIG. 2 is a fragmentary plan view, illustrating an end portion of one form of the mesh of FIG. 1 before its sides are bent into a channel.
FIG. 3 is a plan view, partly broken away, of a curved row of parallel-axes cans within curved channels of mesh, at least one of the channels having a narrow end flange which is attached to a door or window frame.
FIG. 4 is a plan view, partly broken away, of another arrangement of parallel-axes cans and mesh.
FIG. 5 is a sectional view from a plane comparable to the plane 6—6 of FIG. 1, indicating the mesh and cans as sheathed in plastic (organic plastic or concrete), in a construction element.
FIG. 6 is a sectional view, on a plane enlarged from that of FIGS. 1 to 5, from a plane comparable to the plane 6—6 of FIG. 1, illustrating elongated edge portions of the channels as overlapped at sidewalls of the cans.
FIG. 7 is a plan view of a common type of new or used can, shown as having a preferably sealed-over aperture.
FIG. 8 is a plan view of another optional type of new or used can, partly broken away to disclose can-contained insulation.
FIG. 9 is a sectional view, from a plane comparable to the plane 6—6 of FIG. 1, showing cans and mesh in a bar comprising concrete or the like, and channels of mesh as being overlapped and fastened to can sidewalls.
FIG. 10 is a horizontally sectional view, partly broken away, showing bars of mesh-sheathed cans assembled in a wall structure, ready to be stuccoed, the mesh having end flanges that are fastened to door or window frames.
FIG. 11 is a detail elevational view (or alternatively a plan view), partly broken away, of an assembly of two of the bars at a corner of a plural-sided member (for example, indicating a joint between can-and-mesh rows at a roof peak)
FIG. 12 is an elevational, sectional view, partly broken away, illustrating building walls in section and the ridge portion of a roof.
FIG. 13 is a fragmentary plan view of a row of end-joined cans, before it is sheathed in a channel or channels of mesh.
FIG. 14 is a detail view, illustrating a separate flange or tab element, adapted to be fastened to end portions of mesh channels, for reinforcing and fastening together the channels.
FIG. 15 is an elevational, sectional view similar to FIG. 12, showing curved roof bars.

FIGS. 1 to 9 and 13 indicate the basic construction bar of the invention, comprising rows of cans that are reinforced and bracingly held between channels of mesh having overlapping, elongated edge portions. In each of the forms of the invention shown in FIGS. 1 to 15, this bar comprises adjacent cans, arranged in a row, these cans optionally being new or used but preferably being of an economical used type, the cans being held together between channels of mesh, at least some of the cans being fastened to overlapping edge portions of the mesh by tapping screws, epoxy putty or the like. The mesh may be: of metal (for example, hardware wire cloth, expanded metal or other apertured sheet metal); or of strong, apertured plastic, which optionally may be reinforced by fibers or textile fabric, or coated and stiffened by shellac, or other plastic, including glue. Optionally, the row of cans and mesh may be sheathed in concrete or other plastic in a construction bar or, and preferably, may be fastened to other can-and-mesh bars in a wall frame that is exteriorly stuccoed, and also preferably interiorly plastered with stucco comprising a mixture of cement (portland cement, lime, mortar cement or epoxy or other glue) and fine aggregate (sand, ground or shredded plastic, cinders or the like).

The can 1, shown in FIGS. 6 and 7, may be of the liquid-containing or coffee-containing type — for examples: the currently common coffee can, preferably used and closed at one end by the common plastic cap; or the preferably corrugated type of used tomato-juice or fruit-juice can; or a beer or soft-drink can.

Such a can may have been opened as indicated at 2 and 3. Although the openings of such used cans may be left unsealed when the can's matrix is stiff (for example, stiffly poured concrete), they preferably are sealed, for instance by pieces of adhesive tape. These pieces may be rectangular as at 4 or triangular as at 5; and preferably they are hand-torn from a tape roll that is perforated to permit their easy, manual removal. Preferably, each piece is in the form of a right, isosceles triangle (having two equal sides), repetitively indicated on the roll by a continuous series of punctures, thus involving no loss of material in removing the pieces. The adhesive tape used may be, for example, of the masking or electrically insulating type or may comprise aluminized plastic, rubber, paper-and-glue, or waterproofed cloth. Optionally, the pieces 4 and 5 may be sheathed over with epoxy putty or other strong glue — for example, liquid epoxy cement or shellac or contact cement, poured in a layer over and within the recess of the end caps of the cans.

The new or used can of FIG. 8 is of the common paint-can type, and preferably is a used paint can. It comprises a flanged snap-lid 6, sealingly forced down into tight contact with the bottom of the groove 7 and with the downwardly and inwardly extending annular flange that is integral with this bottom and is covered by the lid in FIG. 8.

The cans may be assembled in straight rows, as illustrated in FIGS. 10 and 12 and in the lower part of FIG. 15, or as exampled in FIGS. 3, 11, and the upper part of FIG. 15 in curved rows. They may be placed in fixtures or forms having low, straight or curved side walls, and while in the fixture one of the channels is stretched over them and while thus stretched screwed, or epoxy-puttied or soldered as at 8, to the can's end walls or side walls.

But when, as is preferable, the mesh is metallic hardware cloth or expanded sheet metal, a strip of it is preferably cut to the proper size and with the aid of machinery stamped or pressed into the desired channel shape. The cans are then assembled within a lower one of the channels; and the top channel is placed over the cans, with lower edge portions that overlap the elongated upper edge portions of the lower channel. Then tapping screws, 9 or 10, are screwed thru apertures of the mesh and into the material of the cans.

As illustrated in FIGS. 6 and 9, and optionally in FIGS. 1 to 5 and 7 to 15, the upper channel 11 and the lower channel 12 have elongated edge portions which overlap at the can sidewalls and are fastened to these sidewalls by the screws 9. Preferably also at least a pair of screws (10) fasten the mesh to end cans of the can row. Although there optionally may be at least one of the screws 9 and 10 in the material of each can, only a few of these screws are necessary. Optional epoxy putty or other stiff adhesive 8 may fasten portions of the mesh to the cans, and optionally bits 13 of epoxy putty or the like may be mounded over the screws; but currently the mounds 8 and 13 of stiff adhesive are not preferred.

As illustrated in FIG. 5, and optionally as in FIGS. 1 to 4 and 6 to 15, the channel 14 and the opposite channel 15 have elongated edge portions which overlap at the end caps of the cans and are fastened to these end caps by screws 10 and 10'. The cans of the type of FIGS. 4 and 5 optionally may be glass or plastic jars, in which event the deeper can-end cap 16 is a metal or plastic cap, screwed or otherwise fastened to one end of the can. But preferably these receptacles of FIGS. 4 and 5 are used coffee cans. As indicated in FIG. 4, these cans or jars are alternated in position, so that each deeper and thicker can-end plastic cap 16 is adjacent to a narrower and thinner can-end cap 17, thus providing an even and straight row of cans. If, as is not now preferred, the thicker end caps 16 were all at the same side of the can row, and each pair of the other, thinner caps 17 were in contact the row would be curved; and in a few instances this arrangement might be desired. As indicated in FIG. 5, a screw is optionally shown as penetrating the thicker end cap 16; but preferably and as illustrated in FIG. 4, screws 10' are placed only thru the caps 17; and only a few of these screws 10' are necessary.

In FIG. 13 and the ceiling portion of the roof structure of FIG. 12 the cans 18 (of metal, plastic or glass) are end-joined. These cans may be bracingly held together only by channels of mesh, but for extra strength and especially when used as quasi ceiling joists or rafters the ends of each adjacent pair of these cans are tightly fastened together within enveloping pieces of adhesive tape, 19, encircling the can ends. The present inventor has discovered that adjoining cans having their abutted ends tightly wrapped in masking or other adhesive tape provide a surprisingly strong elongated row of cans. Such end-joined cans optionally may be used within any of the channels of mesh shown in FIGS. 1 to 6, 9 to 11, 12 and 15. When the cans 18 are of metal or plastic, screws fasten the mesh to can sidewalls; but when, as not now preferred, these cans are of glass the mesh is fastened to them by bits of epoxy putty, silicone rubber cement, or the like, and/or screws or the like that extend thru the mesh and jar or bottle caps.

In each of the disclosed structures the cans preferably are filled with insulation (20 or 21). Since this insulation is within cans, it may be of a very low-cost type — optionally treated with wood or other preservative — for examples: nut, cotton-seed or other seed hulls; sand; cinders; ashes; sawdust; tan bark; bits of pine bark such as are sold for plant mulch; light-weight topsoil or other dust; or bits of foamed-plastic scrap.

The basic construction element of FIGS. 1 to 9 and 13 provides strengthening framework in more complex structure, of which several examples are illustrated in FIGS. 10, 11 and 12 to 15. FIGS. 3 and 10 illustrate such elements as embodied in a wall, curved in FIG. 3, straight-sided in FIG. 10. For attachment of the bars together or to door or window frames or the like, the mesh channels are provided with attachment flanges. Such flanges optionally may be on both of the opposite channels or only on one. As shown in FIG. 3 or the right-hand part of FIG. 10, only one, relatively narrow flange (22) of each pair of the opposite mesh channels is utilized to fasten the bar to a door or window frame. The flange 22 is nailed or screwed (and optionally glued with bits of epoxy putty or the like) to the vertical side 23 of the door or window frame. As shown in the left-hand part of FIG. 10, two opposite flanges 22 are fastened by rod-like elements (nails or screws) to the frame. For ease of construction, only one flange 22 at the frame suffices; and a few bits of epoxy putty may be placed on the mesh and frame at a point opposite to 22.

In forming a corner or joint of the type illustrated in FIGS. 10, 11, 12 and 15, at least one of the opposite channels of mesh, in one bar of each jointed pair of bars, has an end attachment flange that is wide enough to sheathe most or all of the end can of the adjoining bar. In the horizontally sectional view of FIG. 10, the outside mesh channel of the bar 24 has at one end the narrow flange 22 (illustrated also in FIG. 1), and at its other end a flange 25 which is sufficiently wide to at least cover most of the end can 26 of the adjoining bar 27, and preferably as shown overlaps two cans of the bar 27. It is fastened to the outside channel 28 by two screws 29.

The joint illustrated in FIG. 11 optionally may be utilized either as a corner between vertical walls or in the roof of FIG. 12. In forming this joint, a pair of end flanges 30 at opposite portions of the upper end of the bar 31, which are similar to the flanges 25, are slightly spread apart and straddled over the end can 32 of the bar 33 and over the mesh-end portions which sheathe the end caps of the can 32. (Only one of these two flanges 30 is viewed in FIG. 12). After thus being straddled over the end can 32, the ends 34 of the flanges 30 are hammered into engagement with the sidewall of the can 32. The ends 35 of the similar flanges at the end of the bar 33 (within the flanges 30) have been similarly formed before the above-described assembly. In completing the joint: the sheet metal screw 38 is driven into the end cap of the can 32, extending thru the overlapped end flanges 30, and preferably mounded over by the epoxy putty or other bonding material 13; and when, as is preferred, there are channels of mesh on both ends of each can, a similar screw and mound of bonding material are placed thru and over the other overlapped mesh-end portions of the joined channels.

When the FIG.-11 type of joint is used at the roof peak of FIG. 12, the hammered-over ends 34 and 35 of the flanges, as here shown, optionally may be eliminated. The attic-frame (roof-and-ceiling) part of this figure comprises juxtaposed, triangularly-shaped frame members, each of which includes rafter-like bars 36A and 36B, angularly joined at the ridge of the roof, and a ceiling-joist bar 37, angularly joined to the ends of the bars 36A and 36B. The cans of these bars, shown as having parallel axes, are of the type illustrated in FIG. 1; or, for extra strength, each row of them may be curved in the manner of FIGS. 3 and 11. But optionally these cans may be end-joined, of the type shown in FIG. 13 and in the ceiling of FIG. 12. The ridge joint between the upper ends of the bars 36A and 36B comprises an end flange 38A on the channel 39 of the bar 36A. Preferably, there are two parallel end flanges 38A which straddle and are fastened by screws 40 and/or bonding material to an end can or pair of end cans of the bar 36B.

These attachment flanges may be integral with the channel 39, as in FIG. 11; or optionally they may comprise separate pieces of mesh of the type shown in FIG. 14. Here, the attachment flange 38A is integral with a portion 41 of the piece of mesh; and such a portion is adapted to be fastened by epoxy putty, solder, or other bonding material to the upper end of a mesh channel 39 on each upright side of the bar 36A. Preferably each mesh channel 39 is fastened to at least the three upper cans by the screws 42; and when the attachment flange 38A is in a separate piece of mesh the screws 42 also extend thru the reinforcing portion 41. Screws also fasten the upper end of the mesh channel 43; this channel is illustrated as having no upper attachment flange.

Each of the side-by-side ceiling-joist bars 37 optionally may comprises parallel-axes cans of the type of FIGS. 1 to 11; but preferably and as illustrated these bars comprise the end-joined cans 18, preferably strongly connected by the adhesive tape 19 and/or epoxy putty. At least some of the end ones of these cans are fastened to the incasing channels of mesh, which have overlapped, elongated edge portions, by screws 44. (For clarity of illustration the showing of these screws is very enlarged.) The bars 37 are joined to lower ends of the bars 36A and 36B by means of the attachment flanges 45 on the lower ends of each pair of the mesh channels and screws 42 which extend thru these flanges 45 and also thru the end portions of the mesh channels of 37 and into sidewalls of the cans 18.

Preferably, the triangular members comprising the adjoined bars 36A, 36B and 37, are subassembled; and then these thru-part members are juxtaposed and fastened together by epoxy putty or by mortar comprising portland cement, lime and fine aggregate. Currently, mortar of this type between the sides of these members is preferred, as an inexpensive material forming with the wire mesh strong vertical junction plates between the attic-frame members.

The roof of FIG. 12 rests on and is fastened to side walls by means of the mortar or epoxy 46, 47 and/or by other fastening means (for example anchoring bolts). Each of these walls comprises channels of mesh and cans between each opposite pair of the channels. These cans optionally may have parallel axes of the type shown in each of FIGS. 1, 3, 4 and 10; but as illustrated they are end-joined cans of the kind shown in FIGS. 13 and 12 at 18. Each of the upper bars of these walls is stacked on and joined to lower horizontal bars by a layer of mortar or epoxy putty 47 or 46. After the can-and-mesh framing of FIG. 12 (or of FIG. 15) is formed, stucco is troweled or sprayed on its exterior and preferably also on its interior. This stucco 48 comprises cement (portland cement, mortar cement, or epoxy, or the like), mixed with fine aggregate. The roof portion (48', FIG. 15) of this stucco preferably comprises epoxy or other organic or synthetic plastic.

The alternative type of roof shown in FIG. 15 is upwardly curved, and preferably nearly flat. Here all the cans are exampled as having parallel axes; but optionally any or all of these cans may be end-joined, of the type shown at 18 in FIGS. 12 and 13. Each pair of the stacked bars of the vertical walls optionally may have a layer of mortar (47, FIG. 12) between them, but as illustrated in FIG. 15 they are fastened together by intermittently placed small masses of epoxy putty or other stiff adhesive. The attachment flanges 45 are integral with the arched-roof mesh channel 49 of the roof bars. Since the upper and lower curves of these rafter-like roof bars have long radii these curves of the mesh channels may be easily formed under pressure of a press, the die of which slightly crumples the upright portions of the channels in small folds. These folds further reinforce the mesh-and-can bar. Between the roof and ceiling-joist bars, insulation, indicated at 50, preferably is placed. The stucco 48A on one side of the roof illustrates an optional shape of the architrave; but preferably its surface on both sides is vertically planar, as indicated at 48. When the stucco comprises portland cement it is preferably waterproofed by at least two coats of masonry paint, of the Stadri or Bondex type.

Various changes may be made within the scope of the following claims. For instance, while the parallel-axes cans of FIGS. 1 to 12 and 15 are in a fixture — before incasing them in the channels of mesh — a V-shaped mass or strip of insulation (51 in FIG. 3 — for example, of foamed plastic or fiberglass) may be glued, adhesive-taped or otherwise fastened in the outer groove, on and between each pair of the parallel-axes cans. Or, before application of the mesh channels around each row of the parallel-axes cans or of the end-joined cans 18, these channels may be glued to and lined by thin layers of insulating foamed-plastic sheeting. Also within the scope of the claims the flange 25 of FIG. 2 may be formed not by cutting out corner portions of a rectangular piece of mesh as in FIG. 2 but simply by cutting the rectangular piece along the two lines 52; and thereafter the corner portions may be bent around cans for further strengthening of the construction member. Otherwise, the flange 25 may be a separate piece, somewhat similar to that of FIG. 14, bonded to the can-holding channel.

In the claims, unless otherwise qualified, the word "can" means a tubular element of metal, plastic or glass, of any cross-sectional shape; "rod-like element" means a screw, nail, rivet or bolt; "stucco" means material which is plastic or liquid when applied and sets with passage of time (for instance, mortar or other concrete, organic or other plastic or any cement mixed with fine aggregate); and "gaseous material" means air, or any pure gas, mixture of gases, or gas-containing insulation or plastic (for example, foamed plastic), under atmospheric or above-atmospheric or sub-atmospheric pressure.

I claim:

1. A plural-sided construction member, including:

a plurality of end-joined sheathed-can rows, each of said rows comprising: a plurality of cans having their axes substantially arranged in a line; encompassing said cans, a pair of oppositely positioned, partially telescoped channels of apertured stiff material, having apertures adapted to receive and hold stucco, one of said channels having an opposite, spaced pair of elongated edge portions each of which is contiguous to and overlaps an elongated edge portion of the other of said channels; and means extending thru apertures in said contiguous, lapped edge portions for fastening said channels together and to the row of cans;

means fastening together each adjacent pair of sheathed-can rows at row ends in a strength-providing joint of said member, comprising: a row-end attachment flange on a said channel, extending beyond end cans of the row to which the channel is connected, and at said joint overlapping a joint portion of a channel of a second sheathed-can row and overlapping an end can of said second row; and attaching means, passing thru said row-end flange, thru said lapped joint portion, and fastened to said end can.

2. A construction member as set forth in claim 1, in which the said material of the channels comprises metallic mesh.

3. A construction member as set forth in claim 1, further including stucco, impregnating and coating said apertured stiff material.

4. A construction member as set forth in claim 1, in which said cans contain gaseous material.

5. A construction member as set forth in claim 4, in which said gaseous material comprises an insulating mixture of particles and air between particles.

6. A construction member as set forth in claim 5, in which said particles are of dirt.

7. A construction member as set forth in claim 1, further including a second row-end attachment flange on a mesh channel at the opposite end of said row from the first-named flange, the said second flange being narrower than said first-named flange and adapted to be fastened to a door or window frame.

8. A construction member as set forth in claim 1, generally triangular in shape, having three of said sheathed-can rows each adjacent pair of which are angularly joined together in a said joint; one of said three rows being a ceiling-joist bar; and the other two of said rows being upright and joined together in a roof-ridge frame portion.

9. Structure as set forth in claim 1, comprising a plural-sided, attic-frame member, including: a lower ceiling-joist bar, comprising a said row of cans and can-incasing pair of channels; and upper roof structure that is adapted to support roofing material comprising cans and mesh channels encompassing these cans, having a summit portion that is higher than each of its two lower end portions, adapted to conform to a water-shedding roof; a said means fastening together an adjacent pair of can rows, connecting each of said lower end portions to an end portion of said ceiling-joist bar, forming two angular joints.

10. Structure as set forth in claim 9, in which said roof structure includes an upwardly arched bar, comprising a said sheathed-can row, the said angular joints being between lower end portions of said arched bar and said ceiling-joist bar.

11. Structure as set forth in claim 9, in which said roof structure includes two of said sheathed-can rows, adjoined at said summit in an angle, and a said means fastening together an adjacent pair of can rows, angularly connecting together ends of said last-named two sheathed-can rows at said summit.

12. Structure as set forth in claim 9, further including: other similar attic-frame members, parallel to said first-named attic-frame member, forming roof framing; and water-shedding roofing material, attached to said roof structure.

13. A construction member as set forth in claim 1, in which said row-end attachment flange is a separate piece of apertured stiff material; the said construction member further including means attaching said separate piece to the said channel on which it is located, at said end cans of the first-named row.

14. Structure as set forth in claim 1, including a plural-sided, upright-wall member, comprising: at least two angularly-joined bars, each including a said row of cans and can-incasing pair of channels; a said joint angularly connecting adjacent ends of said two bars; and a second attachment flange at the end of one of said bars which is opposite to the end at said joint, adapted to be fastened to a wall-opening frame.

15. Structure as set forth in claim 14, further including: other, similar upright-wall members; means fastening each adjacent pair of said upright-wall members together in an upright stack of these members; a wall-opening-closure frame; and at least one rod-like element fastening each said second attachment flange to said frame.

16. Structure as set forth in claim 15, in which said means fastening each adjacent pair of said wall members together comprises a layer of mortar.

17. A light-weight construction member, including:

a row of aligned, contiguous cans, each of said cans comprising a tube and a pair of can-end covers fixed to opposite ends of said tube;

a channeled can-supporting element of stiff, shape-holding, member-strength-providing material, extending over and contiguous with said cans, comprising: a middle piece, having a length in the neighborhood of the length of the said row of cans; and a pair of elongated side flanges of said material, integral with said middle piece and embracing portions of said cans, one of said flanges being located on each side of said piece and having a length substantially equal to the said length of said piece;

a second channeled can-supporting element of stiff, shape-holding material, extending over and contiguous with said cans, comprising: a second middle piece, having a length in the neighborhood of the length of said row of cans; and a pair of elongated side flanges of said material, integral with said second middle piece and embracing portions of said cans, one of said last-named flanges being located on each side of said second piece and having a length substantially equal to the length of said second piece;

the said pair of side flanges of one of said channeled elements having a pair of elongated edge portions which overlap a pair of elongated edge portions of the other of said channeled elements;

fastening means extending thru apertures in lapped portions of the material of both of said pairs of elongated edge portions, connecting said edge portions to at least one can at each end of said row, holding said channeled elements together and said cans within the channeled elements; and at least one attachment piece of stiff, member-strength-providing material, connected to one of said middle pieces and jutting beyond a row-end can, adapted for fastening to another construction element in a building structure.

18. A construction member as set forth in claim 17, in which: said cans are end-joined; and said construction member further includes means fastening together each adjacent pair of the ends of said cans.

19. A construction member as set forth in claim 17, in which: the said cans have substantially parallel axes; and the said fastening means extending thru apertures in lapped portions of material comprise rod-like elements.

* * * * *